US006237544B1

(12) United States Patent
Croxford et al.

(10) Patent No.: US 6,237,544 B1
(45) Date of Patent: May 29, 2001

(54) WATER HEATER AND GAS BURNER

(75) Inventors: Bernard Croxford, Highett; Agostino Zuccon; Richard Rees, both of Moorabbin, all of (AU)

(73) Assignee: Aqua Max Pty LTD, Moorabbin (AU)

( * ) Notice: Subject to any disclaimer, the term of this patent is extended or adjusted under 35 U.S.C. 154(b) by 0 days.

(21) Appl. No.: 08/892,966

(22) Filed: Jul. 15, 1997

(30) Foreign Application Priority Data

Jul. 15, 1996 (AU) ..... PO1029

(51) Int. Cl.[7] ..... F22B 5/00

(52) U.S. Cl. ..... 122/14.22; 122/18.1; 122/19.2

(58) Field of Search ..... 126/39 E, 39 R; 431/354, 326; 122/14.1, 14.2, 14.22, 18.1, 19.2

(56) References Cited

U.S. PATENT DOCUMENTS

| | | | | |
|---|---|---|---|---|
| 794,545 | * | 4/1905 | Phillips, Jr. | 431/354 |
| 1,637,395 | * | 8/1927 | Shuell | 122/13.1 |
| 2,036,136 | | 3/1936 | Guarcello . | |
| 2,257,385 | * | 9/1941 | Keegan | 122/13.1 |
| 2,506,336 | * | 5/1950 | Bock | 122/14 |
| 3,064,720 | * | 11/1962 | Keating et al. | 431/354 |
| 3,074,469 | * | 1/1963 | Babbitt et al. | 431/354 |
| 4,373,472 | * | 2/1983 | Kreis | 122/14 |
| 4,394,848 | * | 7/1983 | Siebelt | 122/13.1 |
| 4,438,728 | * | 3/1984 | Fracaro | 122/14 |
| 4,479,484 | * | 10/1984 | Davis | 126/350 R |
| 4,632,066 | * | 12/1986 | Kideys | 122/13.1 |
| 5,146,911 | * | 9/1992 | Adams | 126/350 R |
| 5,335,646 | * | 8/1994 | Katchka | 126/350 R |
| 5,355,841 | * | 10/1994 | Moore, Jr. et al. | 122/14 |
| 5,361,729 | | 11/1994 | Trihey . | |
| 5,464,005 | * | 11/1995 | Mizrahi | 126/39 R |

FOREIGN PATENT DOCUMENTS

| | | |
|---|---|---|
| B150 794/79 | 3/1980 | (AU) . |
| A172 058/81 | 5/1982 | (AU) . |
| A38573/93 | 12/1992 | (AU) . |

* cited by examiner

*Primary Examiner*—Stephen Gravini
*Assistant Examiner*—Jiping Lu
(74) *Attorney, Agent, or Firm*—William S. Ramsey

(57) ABSTRACT

A water heater includes a tank 10 arranged inside a casing 20 with a burner 16 below the tank so that a heat exchange zone 15 surrounding the tank receives the combustion products. The tank 10 is supported on three edge contact projections 26 resting on ledges 27 located a substantial distance up the sides of the tank. The casing 20 narrows in the upwards direction and a heat shield 30 is coaxially located in the lower portion of the casing where the hottest gases are. A downwardly extending flue 49 outside the casing provides a heat trap. The burner 15 has a burner ring 60 with a unique arrangement of burner ports 62 and a secondary air guide 80. The thermostat probe 14 for the gas valve 17 passes through the heat exchange zone 15 to be intentionally affected by the heat and reduce the achieved operating temperature differential.

4 Claims, 6 Drawing Sheets

WATER HEATER AND GAS BURNER

FIELD OF THE INVENTION

This invention relates to improvements in water heaters (and gas burners for water heaters) in which combustion products are caused to flow past a tank to heat water in the tank.

BACKGROUND TO THE INVENTION

There are many designs of water heaters in which combustion products from a burner are directed to flow in heat exchange relationship to a water tank. One example is shown in U.S. Pat. No. 5,361,729 owned by the present applicants in which combustion products from a burner below the tank are directed to flow up one side of the tank, across the top, and down the other side(s) and thence to an external balanced flue. Although very effective in operation, this water heater requires relatively complex sheet metal components particularly to define the flow paths for the combustion products up one side and down the other side of the tank.

Another water heater is shown in patent specification AU-38573/93 in which combustion products are directed up through a central flue extending centrally through the height of the tank. Complex baffle arrangements are used to try to increase the efficiency of extraction of heat from the combustion products. Also there are problems with sealing the flue at the top and bottom of the tank.

In water heaters where water is heated in a storage vessel or tank and from which water is to be drawn at a temperature within a predetermined range, it is usual to provide a thermostat probe which extends into the tank to sense the temperature of the water in the tank. If the temperature of the water in the tank falls, e.g. due to progressive loss of heat through the tank to the ambient surroundings, or due to tapping of water from the tank and the consequent introduction of replacement cold water into the tank, the temperature probe senses the fall in temperature and initiates operation of heating means associated with the tank. In the case of a water heater where the heating means comprises a burner for burning of fuel, the heat from which is used to raise the temperature of water in the tank, the sensing of the temperature drop by the temperature probe initiates ignition of the burner. When the water temperature in the tank is raised to a predetermined level as sensed by the temperature probe, the burner is extinguished, by discontinuing supply of fuel.

The lower temperature at which the burner is ignited to heat water in the tank, and the upper temperature at which the burner is extinguished is a function of the construction and operation of the temperature probe. A known and conventional temperature probe used in gas water heaters for domestic and commercial hot water supply comprises a bimetallic rod made of the alloy Invar, a stainless steel alloy. The rod is manufactured to a close tolerance in length and is mounted in association with a gas supply valve so that the outer end of the rod pushes on an operative component of the gas valve to cause it to open when the temperature of water into which the inner end of the rod extends falls to a predetermined level. When the temperature of the water in the tank rises to an upper limit the rod causes the gas valve to close off supply of gas to the burner. The difference between the lower temperature at which the valve is opened and the upper temperature at which the valve is closed is called the "differential" for the particular temperature probe. Commonly available temperature probes for operating gas valves of commercial or domestic water heaters have a differential of 14° C. and this value is prescribed as the maximum differential allowable in regulations of the Australian Gas Association (the regulatory body for setting down and monitoring compliance with standards for gas appliances for the Australian market).

A water heater with a temperature probe and gas valve operating at the maximum allowed differential of 14° C. may be intended to supply hot water at a maximum of, say, 70° C. (which may be diluted to, say, 50° C. by mixing with cold water from the mains supply after the water at 70° C. is drawn from the tank). However with a differential of 14° C., water in the tank can fall to 56° C. before the burner is operated to raise the temperature again. This means that a consumer can find that the domestic hot water supply system when called upon to supply hot water, may do so at a temperature as low as 56° C. (which the downstream dilution may reduce to a temperature in the low 40° C. range)—an unacceptably low temperature for domestic requirements such as showering, bathing, washing dishes, or clothes, washing machines.

Therefore in use it is desirable to have a temperature differential substantially less than 14° C. However it is difficult to obtain commercially temperature probes for use with gas valves for hot water services having temperature differentials substantially less than 14° C. The present applicant sources a special thermostat with a guaranteed differential of 11° C. for use in its domestic and commercial gas hot water systems and this differential of 11° C. is about the best that is being offered in the market. However even a guaranteed differential of 11° C. can produce markedly different temperatures of water being supplied to the user of the hot water system depending on whether the water in the tank happened to be towards the lower end of the temperature range or towards the upper end of the temperature range determined by the differential of the temperature probe being used.

OBJECTS OF THE INVENTION

It is an object of one aspect of the present invention to provide a water heater which can effectively utilise heat from combustion of fuel to heat water in a tank.

It is a further preferred object to provide a water heater which has constructional features enabling advantages in manufacture, assembly or operation to be achieved.

It is a further object of another aspect of the present invention to provide an improved gas burner construction.

It is an object a further aspect of the present invention to provide a water beater having a burner for burning of fuel to heat water in a tank and in which it is possible to substantially improve the temperature differential between the lower temperature limit at which the burner is switched on and an upper temperature limit at which the burner is extinguished.

It is a further and preferred object of the present invention to provide a hot water heater achieving in use a lower differential between the burner ignition and burner extinguishing temperatures than the rated differential of the temperature probe being used in the water heater.

SUMMARY OF THE INVENTION

According to a first aspect of the invention, there is provided a water heater comprising: a tank for storage of water to be heated, the tank having a top, bottom and upright side walls, a casing surrounding the side walls and top of the tank and leaving a heat exchange zone entirely around the side walls of the tank, a burner below the tank for burning of fuel, the burner being spaced below the tank and arranged so that combustion products rise and flow up through the heat exchange zone along the side walls of the tank to heat the water in the tank, and support means arranged so that the tank is located and supported within the casing by the support means, the support means being located a substantial distance above the bottom of the tank so that combustion products flow up the side walls around the entire circumference of the tank for a substantial distance before encountering the support means. This provides an uninterrupted large surface area at the bottom and lower part of the tank for heat transfer from the combustion products.

The support means may be located at a plurality of points around the circumference of the tank, the support means bridging across the heat exchange zone and supporting the upright side walls of the tank. For example, there may be three support means arranged at 120° C. to each other around an upright central axis of the tank. Preferably, each support means provides a point or edge contact at which the weight of the tank is supported, the point or edge contact allowing limited movement for avoiding stresses caused by heat expansion and contraction and for minimising conductive heat loss through the support means. For example, each support means may comprise a projection, such as a lug or fin, mounted to and protecting generally radially out from the side wall of the tank and a support ledge extending inwardly from the casing so that the bottom edge of the projection rests with a point or edge contact on the ledge.

According to a second aspect of the invention there is provided a water heater comprising: a tank for storage of water to be heated, the tank having a top, bottom and upright side walls, a casing surrounding the side walls and top of the tank and leaving a heat exchange zone around the side walls of the tank, a burner below the tank for burning of fuel, the burner being spaced below the tank and arranged so that combustion products rise and flow up through the heat exchange zone along the side walls of the tank to heat the water in the tank, a top heat exchange zone across the top of the tank defined by the casing and into which the combustion products pass after flowing up the side walls of the tank, and a flue for discharge of combustion products into the heat exchange zone casing, the flue including: a take off point opening from the top heat exchange zone, a downwardly extending flue passage, and a balanced flue outlet having an exhaust outlet for discharge of combustion products to atmosphere and an adjacent air inlet for intake of air which flows to the burner, the flue arrangement providing a heat trap to retard heat loss by convective flow when the burner is not operating.

The take off point of the flue may comprise a flue elbow attached to the casing and surrounding a discharge opening provided in the top heat exchange zone, the flue elbow extending outwardly and turning downwardly to convey combustion products into the downwardly extending flue passage. The flue elbow may be made of a plastics material. According to a third aspect of the invention, there is provided a water heater comprising: a tank for storage of water to be heated, the tank having a top, bottom and upright side walls, a casing surrounding the side walls and top of the tank and leaving a heat exchange zone around the side walls of the tank, the casing surrounding the tank narrowing in the upward direction where it extends along the height of the tank so as to provide an upper portion of the casing around an upper portion of the tank and a lower portion of the casing around a lower portion of the tank, a burner below the tank for burning of fuel, the burner being spaced below the tank and arranged so that combustion products rise and flow up through the heat exchange zone along the side walls of the tank to heat the water in the tank, and an inner heat shield surrounding and spaced from the walls of the tank within the lower portion of the casing, the inner heat shield extending down below the bottom of the tank to the vicinity of the burner so that combustion products flow up between the inner heat shield and the side walls of the lower portion of the tank, the inner heat shield being spaced radially inwardly from the lower portion of the casing so that an updraught of air is created between the lower portion of the casing and the inner heat shield, the updraught combining with the flow of combustion products above the inner heat shield and the combined flow then passing up through the heat exchange zone between the upper portion of the casing and the upper portion of the tank. The narrowing of the heat exchange zone enables a sufficient flow velocity to be maintained in spite of the cooling of the gases as they yield heat to the tank. The inner heat shield provides an insulating updraft around its outside and this updraft also assists maintenance of a sufficient flow velocity in the upper regions of the heat exchange zone.

Preferably, the inner heat shield is maintained in spaced relationship to the lower portion of the casing by formations provided by the inner heat shield and/or the lower portion of the casing. The formations may comprise a plurality of dimples formed in the inner heat shield and/or the lower portion of the casing, the dimples extending towards and contacting the other one of the inner heat shield and lower portion of the casing to maintain them in spaced relationship. The water heater may further include a bottom heat shield located within the lower portion of the casing and below the burner, the bottom heat shield providing a shield against radiant heat loss in the downward direction, the bottom heat shield being provided with a condensate drain such as a drain hole, or a drain channel leading to the periphery.

According to a fourth aspect of the invention, there is provided a gas burner for use in a water heater having a tank for storage of water to be heated by combustion products from the burner which in use is located below the tank, the burner including: a burner ring having an upper face provided with a plurality of burner ports, an inlet which opens into the side of the burner ring and through which gas and primary combustion air are introduced into the burner ring for distribution amongst the burner ports, a central hole in the burner ring for enabling secondary combustion air to flow up through the central hole to help support the combustion at burner ports near the central hole, the burner ports being arranged in at least three concentric circles, the ports in the circles being staggered with respect to each adjacent ring of ports so that radial lines from the centre of the burner ring do not pass through the centres of ports in each of any three adjacent rings of ports. Preferably, each circle has an equal number of ports and the centres of corresponding ports in all rings lie on a continuously curved line which is concave inwardly towards the centre of the circles of ports. This promotes efficient use of secondary air.

According to a fifth aspect of the invention, there is provided a gas burner for use in a water heater having a tank for storage of water to be heated by combustion products from the burner which in use is located below the tank, the burner including: a burner ring having an upper face provided with a plurality of burner ports, an inlet which opens into the side of the burner ring and through which gas and primary combustion air is introduced into the burner ring for distribution amongst the burner ports, a central hole in the burner ring for enabling secondary combustion air to flow up through the central hole to help support the combustion at burner ports near the central hole, and a secondary air guide located above the burner ring and arranged to guide secondary air flowing up through the central hole in the burner ring in a radially outwards direction towards flames at the burner ports.

The secondary air guide is preferably generally saucer shaped and has a concavity facing upwardly and a drain hole in the centre for draining condensate from the bottom of the tank through the central hole in the burner ring. The diameter of the saucer shaped secondary air guide is preferably slightly less than the diameter of the circle through the centres of the innermost circle of burner ports, so as not to interfere with the flames at the ports in the innermost circle.

Preferably the burner ring is of flat configuration so as to have a relatively low internal volume and wherein the inlet includes a mixing chamber in which gas and primary combustion air mix before entering the burner ring through the side thereof the inlet further including a transfer portion between the mixing chamber and the burner ring, the transfer portion reducing in height and simultaneously broadening in width so that the gas and primary combustion air mixture passing therethrough from the mixing chamber does not encounter substantial resistance in entering the relatively flat burner ring.

According to a sixth aspect of the invention there is provided a water heater including a tank for storage of water to be heated; a casing surrounding the tank and which defines a heat exchange zone adjacent to the tank; a burner located below the tank and for burning of fuel, the burner being located in relation to the casing in the tank so that combustion products from burning of the fuel pass through the heat exchange zone defined between the casing and the tank and thereby heat the water in the tank; and a temperature probe which projects into the tank to sense the temperature of the water in the tank and to thereby control operation of the burner to maintain a predetermined temperature range of water within the tank, the temperature probe extending through or in close proximity to the heat exchange zone so that combustion products passing through the heat exchange zone affect operation of the temperature probe by causing it to sense a temperature higher than the actual temperature of the water in the tank.

In a preferred embodiment the temperature probe passes through the heat exchange zone, whereby the probe can "falsely" detect a higher temperature than the actual temperature of water in the tank and can therefore initiate shutdown of the burner before the actual water temperature reaches the upper rated temperature limit of the particular temperature probe. As the temperature of water in the tank falls, the temperature at which the burner can be ignited can be substantially unaffected by the placement of the temperature probe (in proximity to or passing through the heat exchange zone), since the water temperature may still be the determining sensed temperature a moderate period after burner shutdown which determines operation at the lower limit of the differential. In this way, a temperature probe having a rated differential of, say, 11° C. can in practice achieve a lesser actual operating differential of, say, 7° C.

Preferably the temperature probe is not exposed directly to the combustion products in the heat exchange zone but is surrounded in that zone by insulating means insufficient to avoid some effect of the combustion products on the temperature sensed by the probe. The insulating means may include a sleeve surrounding the temperature probe and which shields the temperature sensitive element of the probe against direct contact by the combustion products, the sleeve being joined to the tank and being opened into the tank wall so that the temperature probe extends generally co-axially through the sleeve and into the volume of water in the tank, whereby the sleeve will be filled with water from the tank so that as the sleeve is heated by combustion products flowing past the sleeve, the water provides some insulation for the temperature probe passing through the sleeve, and so that as the sleeve is heated by the combustion products, the relatively small volume of water in the sleeve is also heated thereby exposing the temperature probe at least in the zone where it extends through the sleeve to water at a temperature elevated above the temperature of water in the tank so that the probe will commence to sense a water temperature in excess of the actual average water temperature in the tank.

With this possible arrangement, the temperature probe can be caused to sense a water temperature in excess of the actual water temperature in the tank and hence the associated fuel valve can be operated to shut off supply of fuel to the burner thereby extinguishing the burner. With such an arrangement it can be possible to achieve an actual operating differential of about 7° C. even with a temperature probe having a nominal differential of 11° C. As will be appreciated, this can be particularly desirable in a domestic or commercial or even an industrial water heater where the temperature of the water is desirably held within a much closer tolerance than say 14° C. as required in AGA specifications, or even within 11° C. as the applicant's temperature probes provide. Since the temperature probe and associated gas valve can be calibrated to set the desired target temperature for the water (but not the temperature differential which is a function of the construction and operation of the temperature probe), in order to achieve a water temperature of about 70° C., it is possible to calibrate the temperature probe and associated gas valve to operate with a temperature differential from say 65° C. to 76° C. When the water temperature falls to 65° C. the burner is ignited but before the water temperature in the tank reaches 76° C. the water in the sleeve surrounding the temperature probe will cause the temperature probe to sense an elevated water temperature and will switch off the gas valve when the water in the tank has reached only, say, 72° C. Thus the arrangement will maintain the water in the tank between 65° C. and 72° C. in spite of the nominal operating differential of the temperature probe being 11° C.

The sleeve passing through the heat exchange zone and through which the temperature probe itself passes may be surrounded by further insulating material so as to insulate the sleeve against an excessively rapid temperature rise in the sleeve where the temperature probe passes through. This can extend the effective operating differential to one closer to the rated differential of the particular temperature probe. Although this will therefore mean that the temperature in the tank has a greater range of temperatures between its upper and lower values, the provision of additional insulation can be particularly useful for avoiding excessively rapid cycling of the burner. This can be desirable for example in performance testing of the water heater by regulatory or testing authorities. In particular, one test of new water heater appliances involves testing the standby thermal efficiency of the insulation provided by the water heater. One of the tests carried out involves heating the water in the tank of the appliance to a predetermined temperature, then allowing the appliance to stand under quiescent conditions and measuring the time that passes before the thermostat reignites the burner. Although this test is intended to help determine heat loss through the casing or housing of the appliance, the test assumes that the thermostat is going to re-ignite the burner after the temperature differential specified in the regulations, i.e. 14° C., has occurred. That is, the test assumes the water temperature will have fallen by 14° C. when the burner re-ignites. Clearly however if the actual operating temperature differential being achieved is, say, 7° C. as is possible with the present invention, the relatively early re-ignition of the burner that will occur with the appliance using the present invention will be the result of the low temperature differential, not a result of high heat loss through the appliance housing as the test result will assume. Hence for this particular performance testing of an appliance embodying the present invention, significant thermal insulation should be provided around the temperature probe where it passes through the heat exchange zone.

Some, but nevertheless lesser amount, of the thermal insulation material may also be used around the sleeve to avoid excessively rapid cycling, i.e. ignition and extinguishing cycles.

BRIEF DESCRIPTION OF DRAWINGS

Possible and preferred features of the present invention will now be described with particular reference to the accompanying drawings. However it is to be understood that the features illustrated in and described with reference to the drawings are not to be construed as limiting on the scope of the invention. In the drawings.

DETAILED DESCRIPTION OF DRAWINGS

Figure 1:
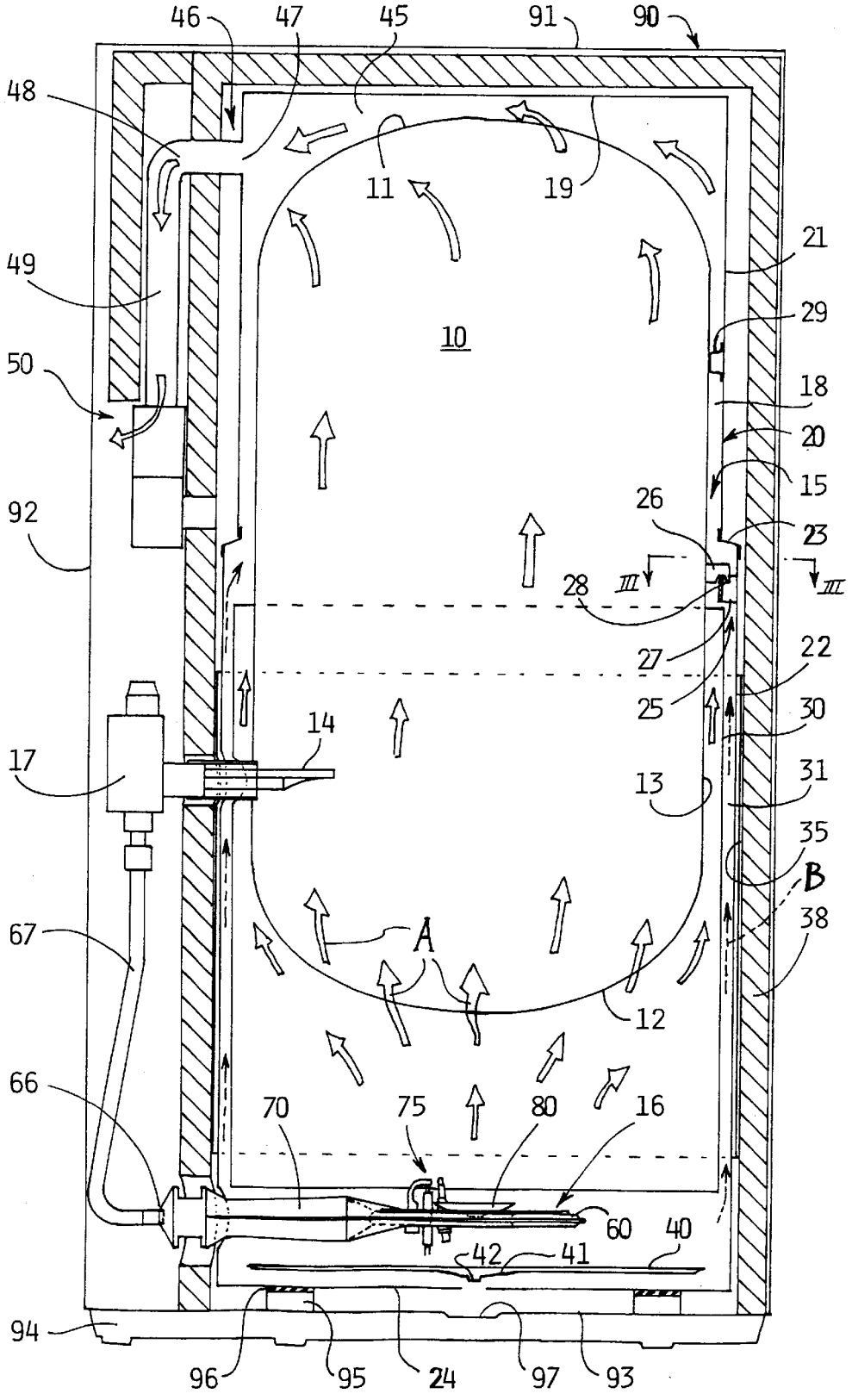
FIG. 1 is a side sectional view of a water heater embodying aspects of the present invention.

Referring to the drawings, the water heater includes a tank 10 for storage of water to be heated. The tank has a top 11 and bottom 12 which are domed, and has a cylindrical side wall 13. The tank may be made of stainless steel and provided with a usual temperature probe 14 associated with a gas valve 17, and conventional fittings including a cold water inlet (not shown) below the level of the probe 14 but at 90° thereto in plan view, a hot water outlet (not shown) at the top of the tank top 11, and a pressure and temperature relief port and associated valve (not shown) positioned either at the top of the tank top 11 or near the top of the cylindrical side wall 13.

A burner 16 is located below the tank 10 and is spaced by a distance so that flames do not impinge directly on the bottom 12 (which would produce carbon monoxide from incomplete combustion). As shown by the arrows A, combustion products from the burner 16 rise to contact the bottom 12 and to flow up through a heat exchange zone 15 which extends up the full height of the walls 13. The heat exchange zone 15 is defined by a casing 20 which surrounds the tank 10 and has a top 19 across the top 11 of the tank 10. Although not illustrated the bottom 12 and/or at least part of the side wall 13 may be provided with heat exchange fins or the like, e.g. made of conductive material such as copper, and projecting out so that combustion products yield up heat readily to the fins which conduct the heat to the tank 10.

Figure 2:
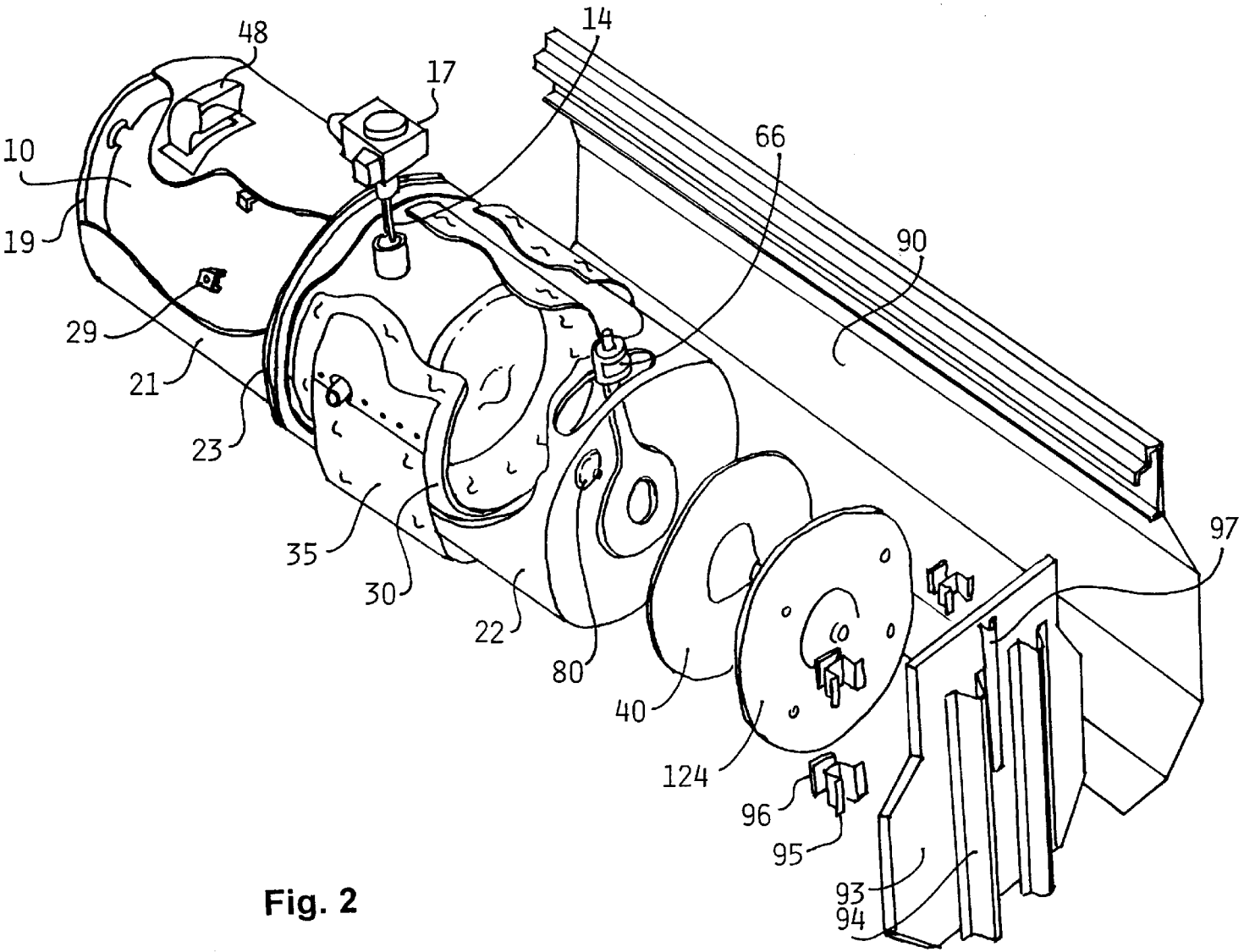
FIG. 2 is an exploded and part sectional view of the water heater of FIG. 1.
Figure 3:
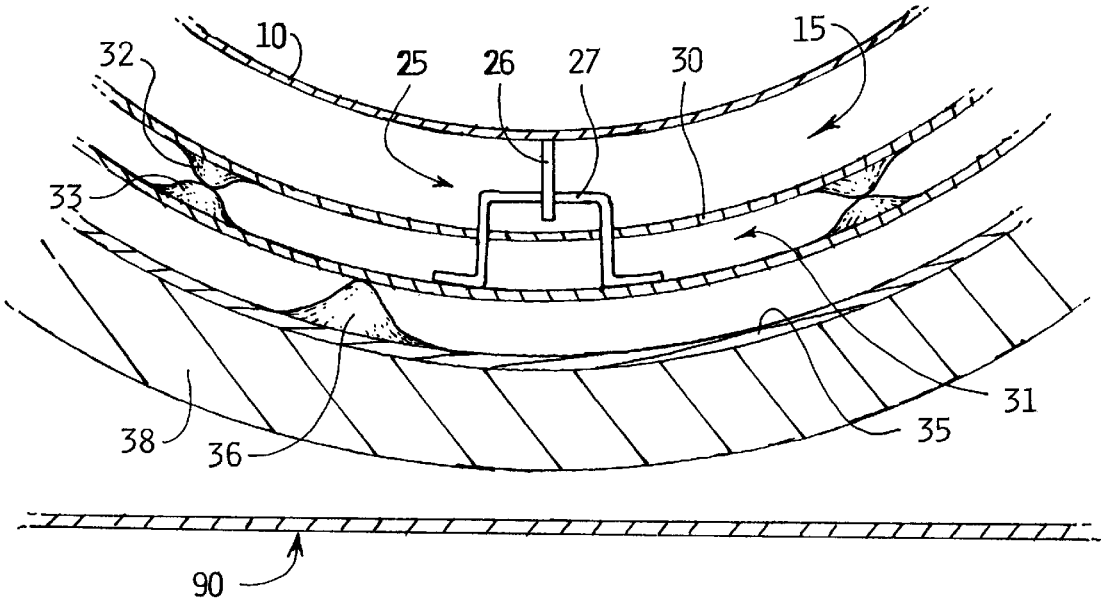
FIG. 3 is a sectional view taken along the line III—III in FIG. 1.

The tank 10 is located and supported within the casing 20 by support means 25 shown in FIGS. 1 and 3 as projections in the form of lugs or fins 26 provided at three points 120° C. apart around the circumference of the tank. The lugs 26 rest with a point or edge contact on ledges 27 mounted to the casing 20. The lugs 26 have notches 28 formed in their lower edges to positively located the lugs 26 on the ledges 27. The point or edge contact enables limited movement of the tank walls 13 to reduce heat expansion stresses and to minimise conductive heat losses from the tank through the support means 25 to the casing 20. Spacer projections 29 are also shown in FIGS. 1 and 2 further up the sides 13 of the tank 10 to centre and maintain the position of the tank 10 inside the casing 20.

The casing 20 narrows in the upwards direction where it extends along the height of the tank 10 so as to provide an upper portion 21 of the casing around the upper part of the tank 10 and a lower portion 22 of the casing around the lower part of the tank. A reducing collar 23 provides the change in diameter. Concentric within the lower casing 22 is an inner heat shield 30 which is spaced from the wall 13 of the tank. The heat shield 30 extends down below the bottom 12 of the tank to the vicinity of the burner 16 so that combustion products flow up between the inner heat shield 30 and the wall 13 of the lower part of the tank 10. Because the combustion products will be at their highest temperature in this lower part of the water heater, the inner heat shield 30 is spaced inwardly of the lower part 22 of the casing 20. This creates an updraught of air in the zone 31 between the lower portion 22 of the casing and the inner heat shield 31. The updraught shown by the arrow B in the zone 31 combines with the flow of combustion products above the top edge of the inner heat shield 30 in the region of the reducing collar 23 and the combined flow passes up through an upper portion 18 of the heat exchange zone 15 between the upper portion 21 of the casing and the upper part of the tank wall 13. The updraught in the zone 31 provides a cooling and insulating effect between the inner heat shield 30 heated by the hottest combustion gases and the lower portion 22 of the casing 20. Also the updraught being combined with the combustion products and flowing into the reduced diameter upper portion 21 of the casing creates a higher velocity flow in the upper portion 18 of the heat exchange zone 15 than would occur with a constant size of the heat exchange zone 15 since the combustion products are continuously being cooled such that their volume reduces as they rise towards the top of the tank. This increase in the velocity of flow in the upper part 18 of the heat exchange zone 15 helps to overcome the flow resistance of the downstream flue path described later.

The inner heat shield 30 is maintained in spaced relationship to the lower portion 22 of the casing 20 by formations shown in FIGS. 2 and 3 as dimples 32, 33 provided in the inner heat shield 30 and casing 20 respectively. The dimples 32, 33 contact each other and a means of fixing, e.g. a spot weld, can be provided at these contact points. Further insulating effect is provided by an outer heat shield 35 located around the lower portion 22 of the casing 20 and maintained spaced therefrom by dimples 36. Further insulation is provided by a layer 38 of insulating material such as fibreglass.

The casing 20 extends down below the burner 16 to a casing support base 24. Also below the burner 16 and slightly above the casing support base 24 is a bottom heat shield 40 which has an outer diameter approaching the diameter of the inner heat shield 30. In the centre of the bottom heat shield 40 is a shallow depression 41 for collecting condensate, the centre of the depression 41 being provided with a drain hole 42. Alternatively, the heat shield 40 may have a drain channel extending radially from the depression 41 to the periphery. The bottom heat shield 40 inhibits loss of heat downwardly by radiation towards the support base 24.

Figure 4:
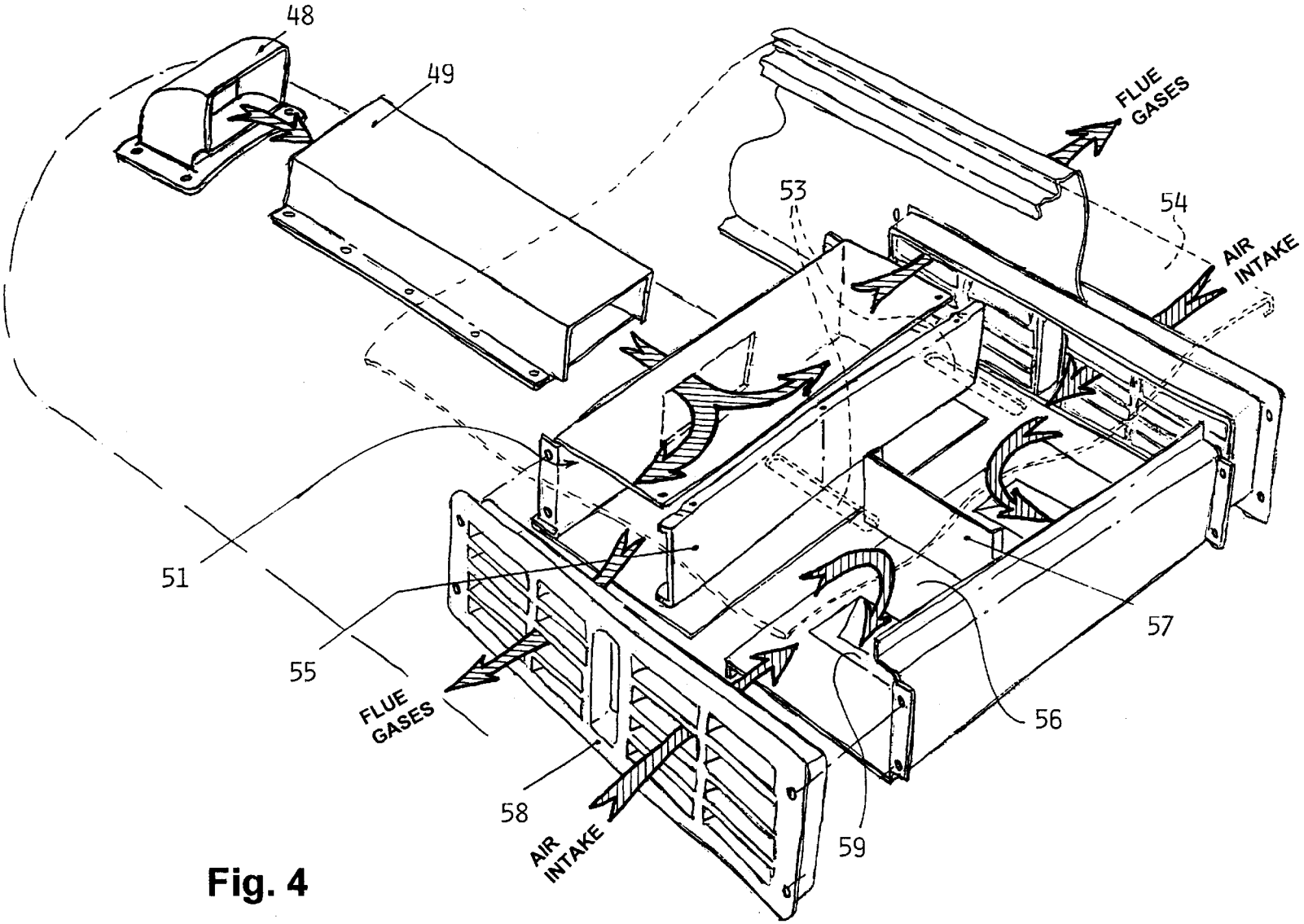
FIG. 4 is an exploded view of the combustion products flue path outside of the casing.

The top 19 of the casing 20 defines a top heat exchange zone 45 across the top 11 of the tank 10 into which combustion products pass after flowing up the walls 13 of the tank. At one side of the top heat exchange zone 45 is a take off point 46 where there is a discharge opening 47 provided in the casing 20, an elbow 48 where the combustion products are turned downwardly so as to flow into the downwardly extending flue passage 49 outside of the casing 20. Although the flue passage 49 is illustrated as a separately manufactured and assembled component, it could be defined by a sloped formation of the casing 30. The elbow 48 may be made of a suitable plastics material since the gases passing through the opening 47 may have cooled by that point to 100–120° C. for example. The flue passage 49 passes down a significant distance (to provide a heat trap) and into a balanced flue outlet 50 (FIG. 4) having an upper outlet diverter chamber 51 having oppositely facing side flue discharge or exhaust openings 52. Adjacent the outlet chamber 51 and separated by a divider panel 55 is an air inlet chamber 56 having a draft divider panel 57 so that strong wind drafts or gusts do not pass directly through the chamber 56 possibly creating a suction. Intake air passes through the front slots 54 in the front cover 53 of the heater and/or through the grilles 58, through openings 59 and thence down to the bottom of the water heater to provide combustion air for the burner 16 (and air for the updraught in zone 31). The flue arrangement having the downwardly directed flue passage 49 provides a heat trap to retard heat loss by convective flow past the heated tank when the burner is not operating.

Figure 5:
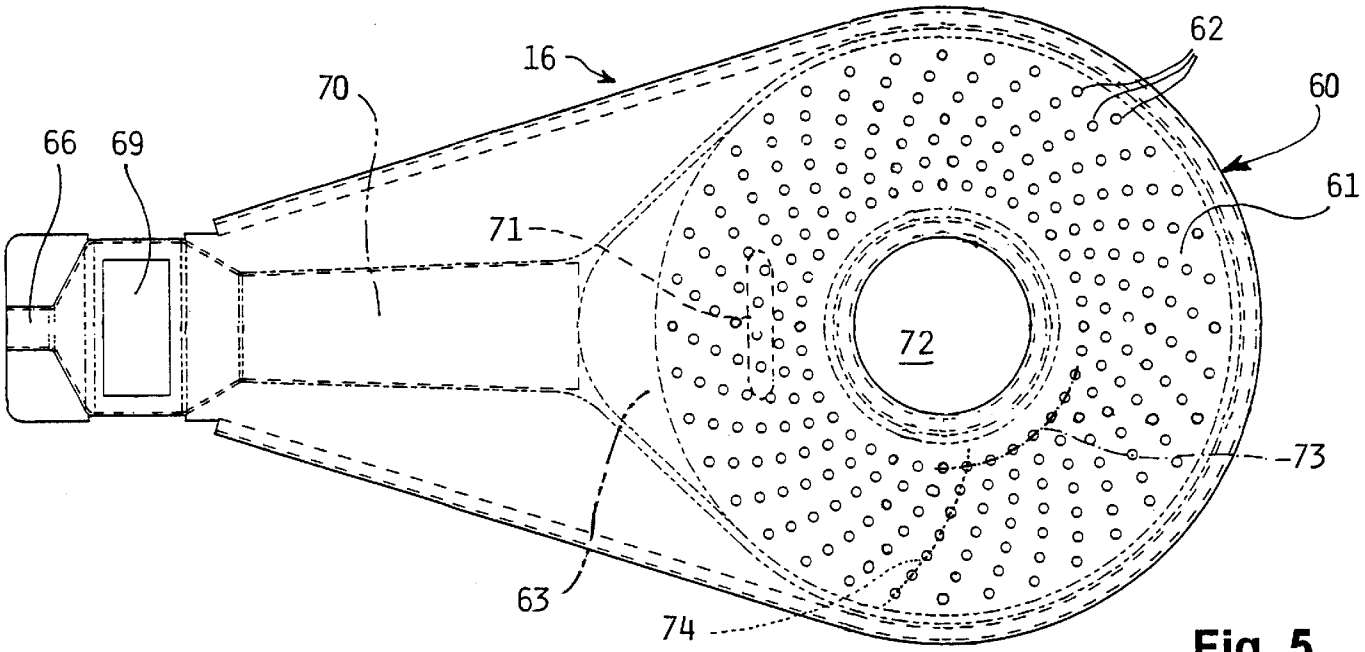
FIG. 5 is a plan view of a burner.
Figure 6:
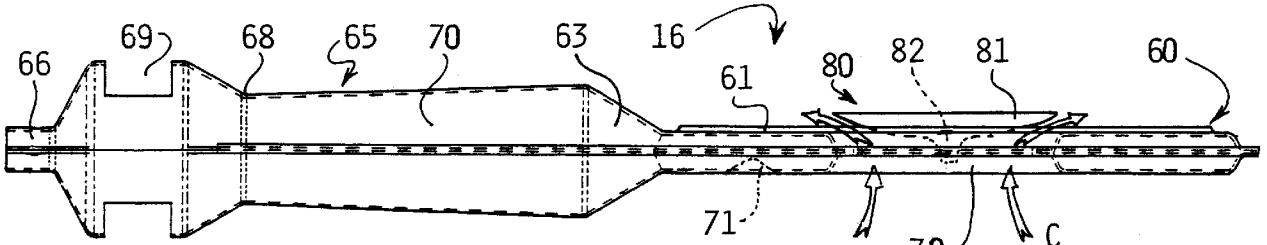
FIG. 6 is a side view of the burner of FIG. 5.

The burner 16 comprises a burner ring 60 having an upper face 61 provided with burner ports 62. An inlet 65 has a gas inlet point 66 which (as shown in FIG. 1) receives gas from gas valve 17 through pipe 67 which fits to the gas inlet point 66. Attached to the burner end of the pipe 67 is an injector (not shown). The gas is injected along the main axis of the burner through a neck 68, drawing primary air through the lateral air ports 69 and thence into the mixing chamber 70. The gas and primary air mixture then passes through a transfer portion 63 and enters the burner ring 60 through the side. The burner ring 60 is constructed to have a relatively flat configuration and hence to have a relatively low internal volume so that, upon the flame being extinguished, there is only a relatively small volume of gas-air mixture and a noisy burn-back into this mixture is avoided. Because the burner ring 60 is flat compared to the height of the mixing chamber 70, the transfer portion 63 reduces in height (as seen in FIG. 6) but simultaneously broadens in width (as seen in FIG. 5) so that the cross sectional area of the transfer portion 63 does not substantially reduce as gas is conveyed into the flat burner ring 60, thus ensuring the gas flow does not meet substantial resistance. On entering the ring 60 the gas and primary air mixture encounters a baffle 71 formed by an indentation in the bottom of the ring 60 so that the burner ports 62 very near to the point where the gas air mixture is introduced are not starved of fuel.

The burner ring 60 is provided with a central hole 72 so that secondary air flows up through the hole 72 to help support combustion at the burner ports 62 nearer to the central hole 72.

The burner ports 62 are arranged in seven concentric circles, the innermost one being indicated by the reference numeral 73. The ports in each circle of ports are staggered with respect to each adjacent circle of ports so that no radial line can be drawn which will pass through the centres of the ports in any three adjacent rings. This arrangement of the ports enables maintenance of a minimum spacing between the ports so that tooling for manufacture of the burner ring is not excessively complicated by provision of extremely close burner ports. Also, excessively close burner ports can produce structural weaknesses in the burner ring.

As shown in FIG. 5, each circle of ports has an equal number of ports (36 in the illustrated embodiment) and the corresponding ports of the circles form a continuously curved line, one of which is shown by the numeral 74 in FIG. 5, the line being concave inwardly towards the centre of the circles. This arrangement of ports in arcuate lines enables the maintenance of a wider spacing between ports in such lines than would be achieved by having straight lines of corresponding ports. Also this arrangement of ports promotes better use of secondary air flowing up and outwardly from the central hole 72 or flowing inwardly by avoiding straight flow paths for secondary air between adjacent radiating lines of ports.

Although the arrangement of the ports has been designed to enable avoidance of very closely spaced ports, nevertheless the arrangement enables the ports to be sufficiently close around at least the inner circle(s) of ports and along the radiating lines of ports for effective cross lighting between burner ports when the flames are being ignited, e.g. from the conventional ignition arrangement 75 shown in FIG. 1.

The burner also includes a secondary air guide 80 located above the burner ring 60 and arranged to guide secondary air flowing up through the central hole 72 in the burner ring in a generally radially outwards direction as shown by arrow C so as to flow towards the flames at the burner ports 62. The secondary air guide 80 is shown as being saucer shaped having a concavity 81 which faces upwardly to trap condensate dropping from the lowermost central bottom point of the bottom 12 of the tank 13 (FIG. 1). There is a drain hole 82 in the centre of the concavity 81 for condensate to drain through the central hole 72 in the ring 60. The diameter of the saucer shaped secondary air guide 80 is slightly less than the diameter of the innermost circle 73 of burner ports 62.

The burner 16 shown in the drawings may be made from pressed metal upper and lower components which are secured together around the outer periphery and around the circumference of the central hole 72 whereby the burner can be made relatively cheaply. The burner ports 62 may be pressed or punched through the sheet metal of the upper face 61 preferably so that they project up above the upper surface 61 by a short distance, e.g. about 1 mm. The inside diameter of each port may be about 3 mm.

The configuration and arrangement of the burner illustrated and described above produces an even flame and good combustion efficiency over the entire upper face 61 of the burner so that in use of the burner in the water heater of FIGS. 1 to 4, an even and uniform flow of combustion products rises around the entire circumference of the tank.

The thermostat probe 14 passes through the heat exchange zone 15 so that the combustion products convey some heat to the probe 14 other than by heating the water in the tank 10 which in turn heats the probe 14.

Figure 7:
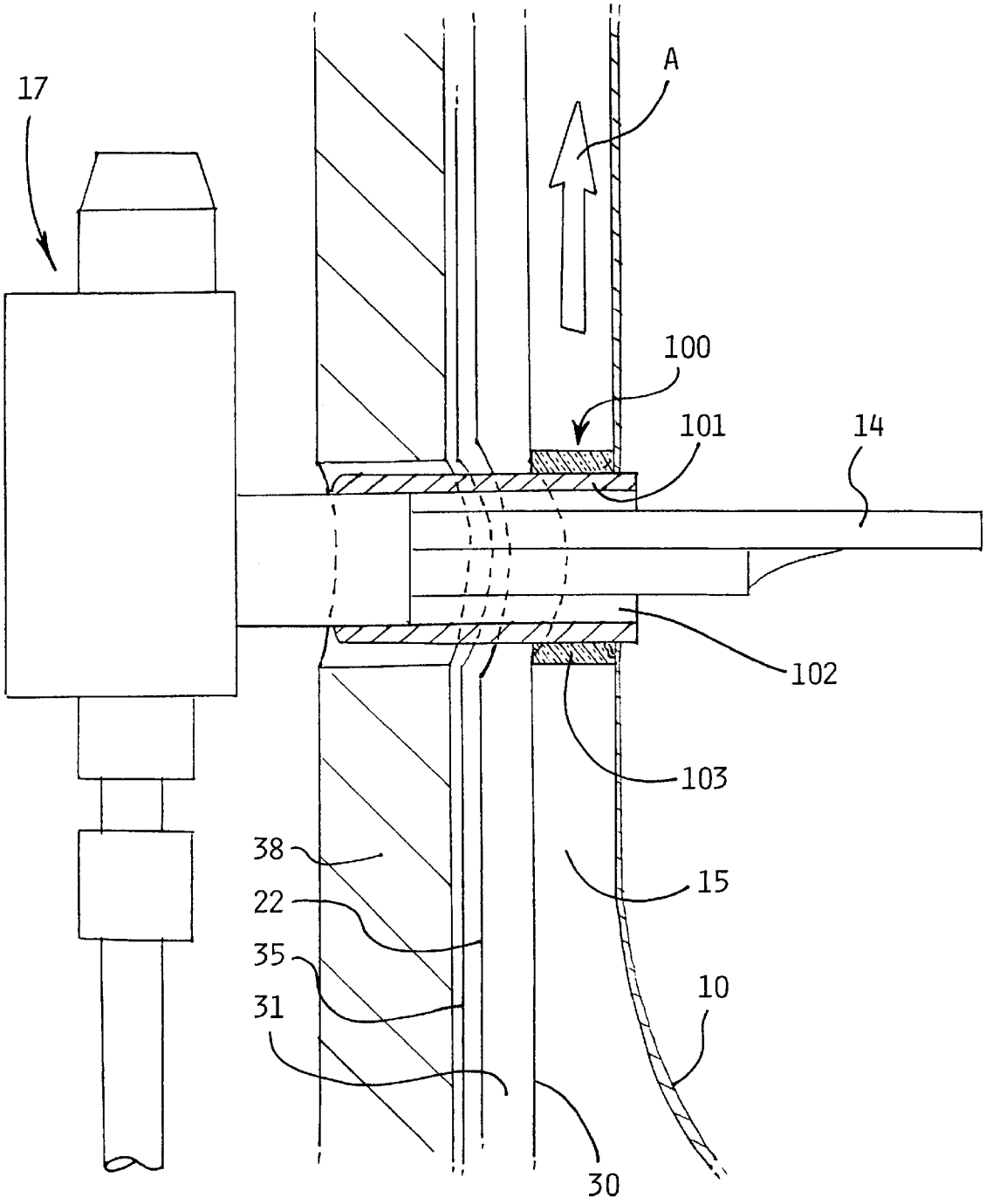
FIG. 7 is a detail of the temperature probe and its mounting.

Referring particularly to FIG. 7, the probe 14 passes generally concentrically through insulating means 100 which includes a sleeve 101 which for example may be a stainless steel sleeve welded to the tank 10. The sleeve 101 opens into the tank 10 so that the space 102 between the probe 14 and the sleeve 101 is water filled. The water in the space 102 provides some insulation so that the probe 14 is not excessively rapidly heated, but nevertheless the probe 14 will be exposed at least along its length in the space 102 to an elevated water temperature causing the probe 14 to sense a higher temperature than the actual average water temperature in the tank 10. Additional thermal insulation material 103 may be provided for purposes as earlier described.

Returning to FIGS. 1 and 2 in particular, the heater can include a generally conventional outer housing 90 having a top 91, side walls 92 in which the openings 52 for flue products and slots 54 and grilles 58 for intake air are provided, and base 93 provided with feet 94. The casing support base 24 can be mounted so as to be spaced above the housing base 93 by means of base support brackets 95 and interposed heat insulators 96 to minimise conductive heat loss. The base 93 can be provided with a central drainage hole. Alternatively, as shown in FIG. 1, there can be a laterally extending drainage channel 97 pressed into the material of the base 93 (or formed separately and mounted on the base 93) for draining condensate laterally.

The heater described and illustrated herein with reference to the drawings has a novel burner which is effective and efficient in providing uniform and complete combustion and directing combustion products in a uniform upwards flow from the upper face 61 towards the bottom of the tank and up around the sides of the tank throughout its circumference. By using the maximum surface area of the tank, particularly efficient and effective heat extraction from the combustion products can be achieved. Heat losses are efficiently and effectively controlled by use of the inner heat shield around the lower portion of the tank and the surrounding updraught zone. The mounting of the tank so that it is effectively suspended with minimal heat loss paths by conduction through the mountings are also provided. The discharge flue arrangement with the downwardly directed passage leading to a balanced flue creates a heat trap so that when the burner is not operating, a convective flow over the tank is minimised leading to substantially less loss of heat from the stored water in the tank. The narrowing of the casing in the upper portion thereof however maintains a sufficient flow velocity of flue gases to overcome the heat trap effect of the downward flue passage during burner operation.

By exposing the temperature probe 14 to some moderate, but not excessive, heating effect from combustion products in the heat exchange zone 15, the heater can maintain in the tank and can deliver water at a temperature within a range smaller than the rated differential of the thermostat probe 14 being used.

The manufacture of the water heater can also be improved compared to prior water heaters since the configuration and arrangement of the heat shields, casing, insulating materials, and outer housing can all be manufactured in straightforward geometries.

What we claim is:

1. A water heater comprising:

a tank for storage of water to be heated, the tank having a top, bottom and upright side walls, a casing surrounding the side walls and top of the tank and leaving a heat exchange zone around the side walls of the tank, the casing surrounding the tank narrowing in the upward direction where it extends along the height of the tank so as to provide an upper portion of the casing around an upper portion of the tank and a lower portion of the casing around a lower portion of the tank, a burner below the tank for burning of fuel, the burner being spaced below the tank and arranged so that combustion products rise and flow up through the heat exchange zone along the side walls of the tank to heat the water in the tank, and an inner heat shield surrounding and spaced from the walls of the tank within the lower portion of the casing, the inner heat shield extending down below the bottom of the tank to the vicinity of the burner so that combustion products flow up between the inner heat shield and the side walls of the lower portion of the tank, the inner heat shield being spaced radially inwardly from the lower portion of the casing so that an updraught of air is created between the lower portion of the casing and the inner heat shield, the updraught combining with the flow of combustion products above the inner heat shield and the combined flow then passing up through the heat exchange zone between the upper portion of the casing and the upper portion of the tank, wherein the inner heat shield is maintained in spaced relationship to the lower portion of the casing by formations provided by at least one of the inner heat shield and the lower portion of the casing.

2. A water heater comprising:

a tank for storage of water to be heated, the tank having a top, bottom and upright side walls, a casing surrounding the side walls and top of the tank and leaving a heat exchange zone around the side walls of the tank, the casing surrounding the tank narrowing in the upward direction where it extends along the height of the tank so as to provide an upper portion of the casing around an upper portion of the tank and a lower portion of the casing around a lower portion of the tank, a burner below the tank for burning of fuel, the burner being spaced below the tank and arranged so that combustion products rise and flow up through the heat exchange zone along the side walls of the tank to heat the water in the tank, and an inner heat shield surrounding and spaced from the walls of the tank within the lower portion of the casing, the inner heat shield extending down below the bottom of the tank to the vicinity of the burner so that combustion products flow up between the inner heat shield and the side walls of the lower portion of the tank, the inner heat shield being spaced radially inwardly from the lower portion of the casing so that an updraught of air is created between the lower portion of the casing and the inner heat shield, the updraught combining with the flow of combustion products above the inner heat shield and the combined flow then passing up through the heat exchange zone between the upper portion of the casing and the upper portion of the tank, wherein the inner heat shield is maintained in spaced relationship to the lower portion of the casing by formations provided by at least one of the inner heat shield and the lower portion of the casing and wherein the formations comprise a plurality of dimples formed in at least one of the inner heat shield and the lower portion of the casing, the dimples extending towards and contacting the other one of the inner heat shield and lower portion of the casing to maintain them in spaced relationship.

3. A water heater including:

a tank for storage of water to be heated;

a casing surrounding the tank and which defines a heat exchange zone adjacent to the tank;

a burner located below the tank and for burning of fuel, the burner being located in relation to the casing in the tank so that combustion products from burning of the fuel pass through the heat exchange zone defined between the casing and the tank and thereby heat the water in the tank;

a temperature probe which projects into the tank to sense the temperature of the water in the tank and to thereby control operation of the burner to maintain a predetermined temperature range of water within the tank, the temperature probe extending through or in close proximity to the heat exchange zone so that combustion products passing through the heat exchange zone affect operation of the temperature probe by causing it to sense a temperature higher that the actual temperature of the water in the tank;

wherein the temperature probe passes through the heat exchange zone, whereby the probe detects a higher temperature than the actual temperature of water in the tank and can therefore initiate shutdown of the burner before the actual water temperature reaches the upper rated temperature limit of the particular temperature probe;

wherein the temperature probe is not exposed directly to the combustion products in the heat exchange zone but is surrounded in that zone by insulating means insufficient to avoid some effect of the combustion products on the temperature sensed by the probe; and wherein the insulating means includes a sleeve surrounding the temperature probe and which shields the temperature probe against direct contact by the combustion products, the sleeve being joined to the tank and being opened into the tank wall so that the temperature probe extends generally co-axially through the sleeve and into the volume of water in the tank, whereby the sleeve will be filled with water from the tank so that as the sleeve is heated by combustion products flowing past the sleeve, the water provides some insulation for the temperature probe passing through the sleeve, and so that as the sleeve is heated by the combustion products, the relatively small volume of water in the sleeve is also heated thereby exposing the temperature probe at least in the zone where it extends through the sleeve to water at a temperature elevated above the temperature of water in the tank so that the probe will commence to sense a water temperature in excess of the actual average water temperature in the tank.

4. A water heater including:

a tank for storage of water to be heated;

a casing surrounding the tank and which defines a heat exchange zone adjacent to the tank;

a burner located below the tank and for burning of fuel, the burner being located in relation to the casing in the tank so that combustion products from burning of the fuel pass through the heat exchange zone defined between the casing and the tank and thereby heat the water in the tank;

a temperature probe which projects into the tank to sense the temperature of the water in the tank and to thereby control operation of the burner to maintain a predetermined temperature range of water within the tank, the temperature probe extending through or in close proximity to the heat exchange zone so that combustion products passing through the heat exchange zone affect operation of the temperature probe by causing it to sense a temperature higher that the actual temperature of the water in the tank;

wherein the temperature probe passes through the heat exchange zone, whereby the probe detects a higher temperature than the actual temperature of water in the tank and can therefore initiate shutdown of the burner before the actual water temperature reaches the upper rated temperature limit of the particular temperature probe;

wherein the temperature probe is not exposed directly to the combustion products in the heat exchange zone but is surrounded in that zone by insulating means insufficient to avoid some effect of the combustion products on the temperature sensed by the probe;

wherein the insulating means includes a sleeve surrounding the temperature probe and which shields the temperature probe against direct contact by the combustion products, the sleeve being joined to the tank and being opened into the tank wall so that the temperature probe extends generally co-axially through the sleeve and into the volume of water in the tank, whereby the sleeve will be filled with water from the tank so that as the sleeve is heated by combustion products flowing past the sleeve, the water provides some insulation for the temperature probe passing through the sleeve, and so that as the sleeve is heated by the combustion products, the relatively small volume of water in the sleeve is also heated thereby exposing the temperature probe at least in the zone where it extends through the sleeve to water at a temperature elevated above the temperature of water in the tank so that the probe will commence to sense a water temperature in excess of the actual average water temperature in the tank; and wherein the sleeve passing through the heat exchange zone and through which the temperature probe itself passes is surrounded by further insulating material so as to insulate the sleeve against an excessively rapid temperature rise in the sleeve where the temperature probe passes through.

* * * * *